United States Patent [19]

Kreiseder

[11] 4,236,280

[45] Dec. 2, 1980

[54] RELEASABLE TIE

[75] Inventor: Walter J. Kreiseder, Kildeer, Ill.

[73] Assignee: Courtesy Mold and Tool Corporation, Wheeling, Ill.

[21] Appl. No.: 14,069

[22] Filed: Feb. 22, 1979

[51] Int. Cl.[3] ..... B65D 63/00

[52] U.S. Cl. ..... 24/16 PB; 24/17 A; 24/73 BC; 24/73 PM

[58] Field of Search ..... 24/16 R, 16 PB, 17 A, 24/17 AP, 19, 73 BC, 73 CM, 73 PM

[56] References Cited

U.S. PATENT DOCUMENTS

| | | | |
|---|---|---|---|
| 3,102,311 | 9/1963 | Martin et al. | 24/16 PB |
| 3,127,648 | 4/1964 | Emery | 24/16 PB |
| 3,339,246 | 9/1967 | Geisinger | 24/16 PB |
| 3,368,247 | 2/1968 | Orban | 24/16 PB |
| 3,581,347 | 6/1971 | Verspieren | 24/16 PB |
| 3,590,442 | 7/1971 | Geisinger | 24/16 PB |
| 3,761,999 | 10/1973 | Morgan | 24/16 PB |
| 3,855,669 | 12/1974 | Meyer | 24/16 PB |
| 3,887,965 | 6/1975 | Schuplin | 24/16 PB |
| 3,900,923 | 8/1975 | Thomas | 24/16 PB |
| 3,906,593 | 9/1975 | Caveney et al. | 24/16 PB |
| 3,942,750 | 3/1976 | Noorily | 24/16 PB |
| 3,983,603 | 10/1976 | Joyce | 124/16 PB |
| 3,991,444 | 11/1976 | Bailey | 24/16 PB |
| 4,008,512 | 2/1977 | Prodel | 24/16 PB |
| 4,011,633 | 3/1977 | Seil | 24/16 PB |
| 4,079,485 | 3/1978 | Collier et al. | 24/16 PB |
| 4,092,765 | 6/1978 | Joyce | 24/16 PB |

*Primary Examiner*—Victor N. Sakran

*Attorney, Agent, or Firm*—Allegretti, Newitt, Witcoff & McAndrews

[57] ABSTRACT

A molded, one-piece plastic strap clamp for binding a plurality of members together comprising a base portion having a free end, a plurality of teeth formed on one side of the base portion intermediate the ends, and a body formed at the other end of the base portion, said body having an opening for receiving said free end, said opening being transverse to the axis of the base portion, said free end being insertable into said opening in a locking direction, at least one lock tooth complementary to said teeth on said base portion, extending into said opening and adapted to engage with a tooth on said base portion for preventing movement of said free end from said opening in a release direction, said lock tooth being actuated by a latch formed integrally with said body and extending outwardly therefrom so as to be readily accessible by the user to release the locked tooth from engagement with a selected tooth on the base portion to permit the free end to be moved in said release direction.

10 Claims, 7 Drawing Figures

RELEASABLE TIE

BACKGROUND AND SUMMARY OF THE INVENTION

This invention relates to an improved one-piece plastic strap clamp and more particularly, to a one-piece plastic strap clamp that includes a body and base portion with complementary cooperating teeth, and with an accessible release latch integrally formed with the body to permit release of the cooperating teeth on the body and base portion of the user as desired.

A variety of strap clamps have been employed in the past for supporting together elongated wires, tubes or similar members. The straps clamps, made in different materials, generally comprise an elongated strap with a retainer or clamp at one end for securing the free end of the strap in bound relationship to the wires, tubes, or similar members. Such clamps originally were intended for one time use and the strap had to be cut or the clamp otherwise severed to release the retained members. Subsequently, releasable strap clamps were provided so as to permit adjustment or release of the strap clamp as desired.

Exemplary prior art pertaining to strap clamps known to applicant includes Vierspieren U.S. Pat. No. 3,581,347; Meyer U.S. Pat. No. 3,855,669; Thomas U.S. Pat. No. 3,900,923; Norily U.S. Pat. No. 3,942,752; Joyce U.S. Pat. No. 3,983,603; Bailey U.S. Pat. No. 3,991,444; Prodel U.S. Pat. No. 4,008,512; Seil U.S. Pat. No. 4,011,633 and Collier U.S. Pat. No. 4,079,485. Vierspieren U.S. Pat. No. 3,581,347 reveals a ring clamp wherein an integral releasable flap is employed to releasably secure the strap. The releasable flap is so constructed and arranged as to be difficult to operate with glooves on the hand of a user. Meyer U.S. Pat. No. 3,855,669 reveals an adjustable strap clamp with a latching lever pivoted on upright leg portions of a U-shaped base. Thomas U.S. Pat. No. 3,900,923 shows a combination strap and buckle for roller skates with a releasable latch means that would be relatively difficult for a user to manipulate with glooves. Noorily U.S. Pat. No. 3,942,750 pertains to an adjustable clamp having a hooked end that is releasable from a locked position in a retainer from exterior of the retainer. Joyce U.S. Pat. No. 3,983,603 and Bailey U.S. Pat. No. 3,991,444 relate to ties having straps with openings and the retainers having a lock tooth for engaging within a selected opening. Prodel U.S. Pat. No. 4,008,512 shows a one-piece releasable band clamp comprising a strap with a body at one end, the body including a transversely movable locking flap for engaging and retaining the strap in selected position. Seil U.S. Pat. No. 4,011,633 relates to a plastic strap clamp that includes a deformable latch that releasably engages the strap. Collier shows a bundle tie which comprises a plastic strap intended for one time use.

An object of the present invention is to provide an improved one-piece plastic strap clamp that is simple in construction and operation, relatively inexpensive to manufacture, and overcomes the disadvantages and deficiencies of the prior constructions.

Another object of the present invention is to provide an improved one-piece plastic strap clamp having a latch extending transversely relatively to the opening in the body so as to be readily accessible by the user for releasing the strap from locking engagement within the opening in the body.

These and other objects and advantages of the present invention will become more apparent from the following description of the present invention.

BRIEF DESCRIPTION OF THE DRAWING

There is shown in the attached drawing a presently preferred embodiment of the present invention wherein like numerals in the various views refer to like elements and wherein.

DETAILED DESCRIPTION OF THE PRESENT INVENTION

Figure 1:
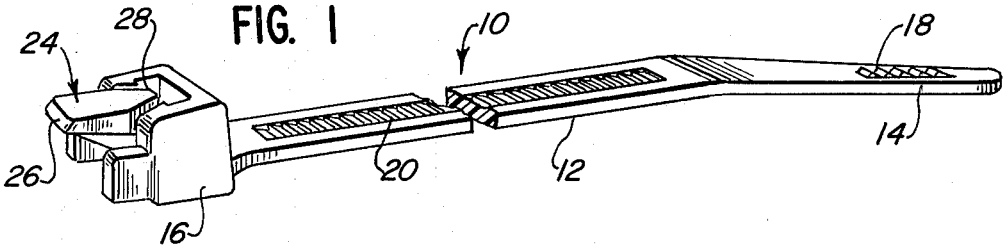
FIG. 1 is a perspective view of the improved one-piece plastic strap clamp of the present invention.
Figure 2:
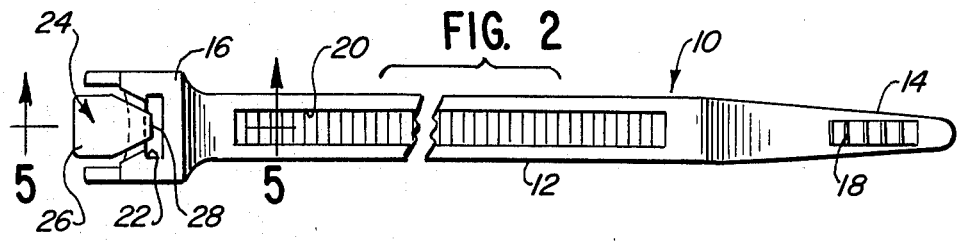
FIG. 2 is a plan view of the one-piece plastic strap clamp of FIG. 1.
Figure 3:
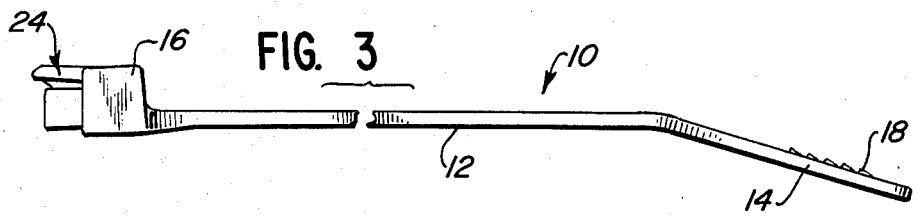
FIG. 3 is a side view of the one-piece plastic strap clamp of FIG. 1.

With reference to FIGS. 1, 2 and 3, there is illustrated the one-piece flexible plastic strap clamp of the present invention. The strap 10 comprises an elongated base portion 12 having a free end 14 and a body 16 integrally formed at the end opposite from the free end. The components are molded so that the free end 14 is normally bent downwardly from the longitudinal axis or plane of the central part of the base portion, approximately 15 to 16 degrees to give direction to use of the strap clamp 10. The user will introduce the free end 14 into the opening 22 in body 16 so that the complementary teeth on the strap and in the body 16 will engage to lock the strap in selected position. The free end 14 is tapered toward its extremity, which is rounded, so as to facilitate entry into transverse opening 22 in body 16. Provided on the free end 14 are a plurality of teeth members or protuberances 18 which facilitate gripping of the free end by the user. The base portion 12 has a plurality of transversely extending teeth 20 on the same side as the gripping teeth 18 on the free end 14.

The body 16 is provided with an opening that extends transversely to the pane of the base portion 12. The opening 22 is slightly longer than the width of the base portion 12 and is slightly wider than the width of the base portion so as to be able to slidingly receive the base portion 12.

Integrally formed in the body 16 is a latch means 24 which includes the actuating member or latch 26 and at least one locking tooth 28. The locking tooth 28 is adapted to cooperate with a complementary tooth 20 on the base portion so as to retain the base portion within the body in securement about members to be bound together as for example, cables, tubes or wires. The latch 26 is integrally molded with the body 16 so as to be deflectable relative thereto by means of its joinder at the lower end so as to release the locking tooth 28 (or teeth if there are two) from engagement with a selected tooth 20 on the base portion so as to permit the base portion to move in a release direction relative to the transverse opening 22 and thereby permit the base portion to be removed from the transverse opening or adjusted as desired.

Figure 4:
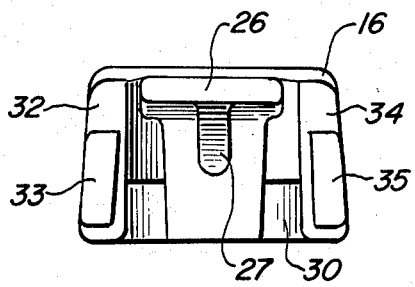
FIG. 4 is an end view of the one-piece plastic strap clamp of FIG. 1 on an enlarged scale.
Figure 5:
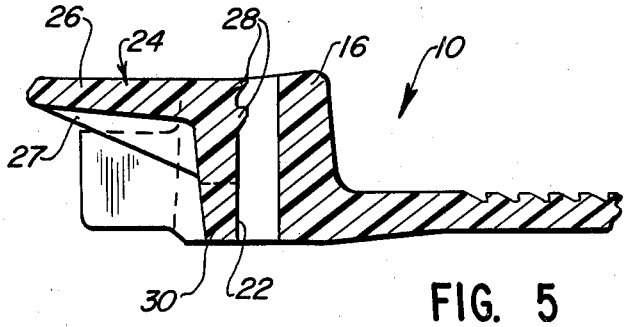
FIG. 5 is a partial cross sectional view of the one-piece plastic strap clamp taken generally along the line 5—5 of FIG. 2.

With reference to FIGS. 4 and 5, there is better illustrated the construction of a body 16 of the strap clamp 10. The body 16 includes an integrally formed lower bridging member 30 to which the latch 26 is joined. The bridging member 30 extends between the sides 32 and 34 of the body 16. Webbing 27 is provided beneath the latch 26 to reinforce the latch. It will be noted that the webbing 27 joins the upright portion of latch 26 just above the bridging member 30. This construction not only strengthens the latch but helps to define the bend line or pivot line of the latch 26. The sides 32 and 34 of body 16 also include rearwardly extending portions 33 and 35. The rearwardly extending portions 33 and 35 are of a lesser height than the sides 32 and 34 of the body 16. These portions 33 and 35 serve to shield the latch 26 from sidewise interference, as well as to provide additional strength to the sides 32, 34 and the body 16.

Integrally formed on the latch 26 for movement therewith and extending into the opening 22 are the locking teeth 28. In the embodiment illustrated, there are two locking teeth on the inner surface of the latch 26 which defines a part of opening 22 in body 16. The locking teeth 28 are complementary to the teeth 20 on the base portion 12 and extend a sufficient distance into opening 22 to cooperate with selected teeth 20 so as to lock the strap clamp 10 in selected position about a plurality of elongated members to be secured to one another.

Figure 6:
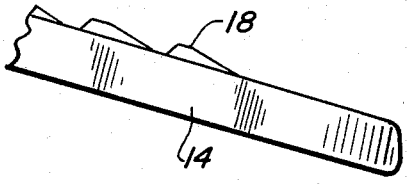
FIG. 6 is an enlarged fragmentary side view of the free end of the one-piece plastic strap clamp better illustrating the gripping protuberances.

Turning to FIG. 6, there is shown an enlarged view of the free end 14 of the base portion 12. The gripping teeth or protuberances 18 extend a relatively short distance from the top surface of the free end 14 so as to facilitate gripping of the free end 14 and thereby enhance tightening of the strap clamp when the free end 14 is inserted through the transverse opening 22 in body 16.

Figure 7:
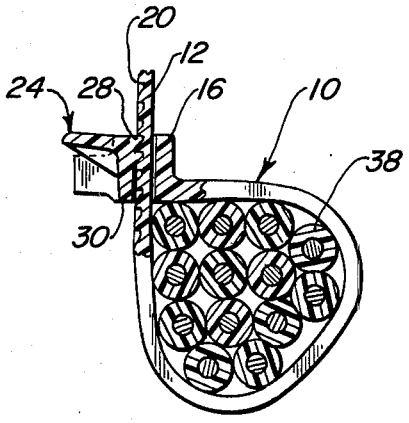
FIG. 7 is a cross sectional view illustrating the one-piece plastic strap clamp in use to fasten together a plurality of wires.

In FIG. 7, there is shown the strap clamp 10 of the present invention secured in position about a plurality of elongated wires 38. The free end 14 is inserted into the transverse opening 22 in the body 16 until the strap clamp 10 is snugly drawn about the plurality of wires or like parts to be joined together in fixed relationship. With the base member 12 tightly drawn about the wires 38, the complementary teeth 20, 28 are in locked relationship as shown in FIG. 7. The edges of the teeth 20 normal to the base portion abut the edges of teeth 28 normal to the inner surface of latch 26. Retrogression or movement in a release direction is prevented because the abutting planar faces of the locking teeth 28 are in engagement with like cooperating surfaces on the selected cooperating teeth 20. Because of the transverse relationship of the opening 22 relative to the plane of the base portion 12, the natural tendancy of the complementary teeth 20, 28 is to more firmly engage one another rather than to release from one another if the base portion is urged in a release direction.

Release of the locking teeth 28 from the teeth 20 on base portion 12 is attained only by positive downward force being applied upon the latch 26, so as to pivot the latch relative to the bridging portion 30 of body 16 and thereby release the lock teeth 28 from engagement with the teeth 20 on the base portion 12. The base portion 12 can now be moved in a release direction in the transverse opening 22 so as to permit adjustment or removal of the strap clamp 10 from the wires 38.

The strap clamp 10 is preferably molded integrally from plastic, such as nylon or polypropylene and possesses sufficient strength and resiliency to permit the desired working thereof, as well as the desired latching and release. The strap clamp 10 may be color coded to enhance its use in certain industrial applications. As is apparent from the foregoing description of the strap clamp 10 is readily releasable by means of the integral latch and can be easily reapplied and adjusted as desired.

While I have shown a presently preferred embodiment of the invention, it will be understood that it is subject to modification and it is intended that the invention be limited only within the scope of the appended claims.

I claim:

1. A molded one-piece plastic strap clamp for binding members together comprising a base portion having a free end, said base portion having opposite sides, a plurality of teeth formed on one side of the base portion intermediate the ends, and a body formed at the other end of the base portion, said body having an opening therethrough for receiving said free end, said opening being transverse to the axis of the base portion, said free end being insertable into said opening in a locking direction and forming a loop to receive the members to be bound, with the plurality of teeth being on the side of the base portion away from the members to be bound, latch means on said body including a latch pivotally supported on said body and at least one lock tooth on said latch complementary to said teeth on said base portion and extending into said opening and adapted to engage with a tooth on said base portion for preventing movement of said base portion in a release direction, said latch formed integrally with said body and extending outwardly therefrom generally parallel to the base portion in the nonuse condition so as to be readily accessible by the user, said latch being deflected about its pivot line on the body to release the lock tooth from engagement with a selected tooth on the base portion to permit the base portion to be moved in said release direction, said base portion being easily releasable from the body and said strap clamp being reusable.

2. A molded one-piece plastic strap clamp as in claim 1, including at least two locking teeth on said body.

3. A molded one-piece plastic strap clamp as in claim 1, wherein said latch extends transversely from said base portion when said base portion is in said opening and is readily accessible by the user for deflection about its pivot line.

4. A molded one-piece plastic strap clamp as in claim 3, wherein the lock tooth is on the side of the opening opposite from the base portion and is directly actuated by movement of the latch so as to move the lock tooth from locking engagement with a tooth a sufficient distance to enable movement of the base portion in a release direction.

5. A molded one-piece plastic strap clamp as in claim 1 wherein the free end is bent relative to said base portion so as to indicate the direction of entry of the free end into the opening in the body.

6. A molded one-piece plastic strap clamp as in claim 5, wherein the base portion extends from the body and the bottom of the base portion is substantially flush with the bottom of the body, and said free end is bent downwardly relatively to the base portion.

7. A molded one-piece plastic strap clamp as in claim 5, wherein gripping teeth are provided on the free end to facilitate gripping of the free end by the user.

8. A molded one-piece plastic strap clamp as in claim 3, wherein the lock tooth is at the top of the body, a bridging member is integrally formed on the body, and the latch is joined to the bridging member, whereby pressure on the end of the latch will pivot the latch about the bridging member and free the lock tooth from engagement with the tooth on the base portion.

9. A molded one-piece plastic strap clamp as in claim 8 wherein the bridging member is below the locking tooth.

10. A molded one-piece plastic strap clamp as in claim 9 including webbing reinforcing the latch and constructed and arranged so as to help define the bridging member as the pivot line for the latch.

* * * * *